US010792783B2

(12) United States Patent
Hu et al.

(10) Patent No.: US 10,792,783 B2
(45) Date of Patent: Oct. 6, 2020

(54) SYSTEM, CONTROL METHOD AND APPARATUS FOR CHEMICAL MECHANICAL POLISHING

(71) Applicant: Taiwan Semiconductor Manufacturing Co., Ltd., Hsinchu (TW)

(72) Inventors: Hsiang-Chu Hu, Tainan (TW); Chun-Hai Huang, Changhua County (TW); Mu-Han Cheng, Tainan (TW); Yu-Chin Tseng, Tainan (TW); Chien-Chih Chen, Changhua County (TW); Tzu-Shin Chen, Tainan (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 329 days.

(21) Appl. No.: 15/869,056

(22) Filed: Jan. 12, 2018

(65) Prior Publication Data

US 2019/0160625 A1 May 30, 2019

Related U.S. Application Data

(60) Provisional application No. 62/591,152, filed on Nov. 27, 2017.

(51) Int. Cl.
*B24B 37/005* (2012.01)
*B24B 37/26* (2012.01)
(Continued)

(52) U.S. Cl.
CPC ..... *B24B 37/005* (2013.01); *B24B 37/042* (2013.01); *B24B 37/20* (2013.01);
(Continued)

(58) Field of Classification Search
CPC ..... B24B 37/005; B24B 37/042; B24B 37/20; B24B 37/26; B24B 49/00; B24B 49/12; B24B 49/18; B24B 53/005; B24B 53/017
(Continued)

(56) References Cited

U.S. PATENT DOCUMENTS 6,040,244 A * 3/2000 Arai ..... B24B 37/005 438/691
6,045,434 A * 4/2000 Fisher, Jr. ..... B24B 49/183 451/6
(Continued)

FOREIGN PATENT DOCUMENTS

CN 101022921 8/2007
CN 102398209 4/2012
(Continued)

OTHER PUBLICATIONS

"Office Action of Korea Counterpart Application," dated Oct. 16, 2019, pp. 1-7.
(Continued)

*Primary Examiner* — Eileen P Morgan
(74) *Attorney, Agent, or Firm* — JCIPRNET

(57) ABSTRACT

A system, a control method and an apparatus for chemical mechanical polishing (CMP) are introduced in the present application. The CMP apparatus may include a polishing pad, a first sensor, a polishing head and a condition. The polishing pad has a plurality of groves arranged randomly or in a specific pattern. The first sensor is configured to measure the pad profile of the polishing pad, where the pad profile includes the depth of each of the grooves on the polishing pad. The polishing head and the conditioner are operated according to at least one polishing condition, and the at least one polishing condition is tuned according to the pad profile.

17 Claims, 6 Drawing Sheets

(51) Int. Cl.

| | |
|---|---|
| ***B24B 49/18*** | (2006.01) |
| ***B24B 53/017*** | (2012.01) |
| ***B24B 37/20*** | (2012.01) |
| ***B24B 49/12*** | (2006.01) |
| ***B24B 49/00*** | (2012.01) |
| ***B24B 37/04*** | (2012.01) |
| ***B24B 53/00*** | (2006.01) |

(52) U.S. Cl.
CPC ..... *B24B 37/26* (2013.01); *B24B 49/003* (2013.01); *B24B 49/12* (2013.01); *B24B 49/18* (2013.01); *B24B 53/005* (2013.01); *B24B 53/017* (2013.01)

(58) Field of Classification Search
USPC ..... 451/41, 56, 443, 5, 6, 9, 10, 11
See application file for complete search history.

(56) References Cited

U.S. PATENT DOCUMENTS

| | | | | |
|---|---|---|---|---|
| 6,872,132 | B2 * | 3/2005 | Elledge | B24B 1/04 451/10 |
| 7,070,479 | B2 * | 7/2006 | Faustmann | B24B 49/02 451/21 |
| 8,043,870 | B2 * | 10/2011 | Manens | B24B 37/042 257/E21.528 |
| 9,138,860 | B2 * | 9/2015 | Dhandapani | B24B 53/017 |
| 9,156,122 | B2 * | 10/2015 | Shinozaki | B24B 37/042 |
| 9,486,893 | B2 * | 11/2016 | Chen | B24B 53/017 |
| 9,802,292 | B2 * | 10/2017 | Chung | B24B 37/005 |
| 10,272,540 | B2 * | 4/2019 | Lai | B24B 49/105 |
| 2007/0015442 | A1 * | 1/2007 | Shin | B24B 37/042 451/8 |
| 2009/0280580 | A1 | 11/2009 | Manens et al. | |
| 2014/0273752 | A1 * | 9/2014 | Bajaj | B24B 53/017 451/6 |
| 2014/0287653 | A1 * | 9/2014 | Shimano | B24B 37/005 451/5 |
| 2017/0239777 | A1 * | 8/2017 | Chung | B24B 37/005 |
| 2018/0207770 | A1 * | 7/2018 | Tolles | B24B 37/26 |

FOREIGN PATENT DOCUMENTS

| | | | |
|---|---|---|---|
| CN | 104002240 | | 8/2014 |
| CN | 106217234 | | 12/2016 |
| KR | 20020088598 | | 11/2002 |
| KR | 20020088598 | A * | 11/2002 |
| KR | 101618354 | | 5/2016 |
| TW | 201334916 | | 9/2013 |
| TW | 201700216 | | 1/2017 |
| TW | 201729946 | | 9/2017 |
| WO | 2005072910 | | 8/2005 |
| WO | 2016048043 | | 3/2016 |

OTHER PUBLICATIONS

"Office Action of Taiwan Counterpart Application," dated Feb. 23, 2019, pp. 1-7.
"Office Action of China Counterpart Application", dated Aug. 13, 2020, p. 1-p. 9.

* cited by examiner

SYSTEM, CONTROL METHOD AND APPARATUS FOR CHEMICAL MECHANICAL POLISHING

CROSS-REFERENCE TO RELATED APPLICATION

This application claims the priority benefit of U.S. provisional application Ser. No. 62/591,152, filed on Nov. 27, 2017. The entirety of the above-mentioned patent application is hereby incorporated by reference herein and made a part of this specification.

BACKGROUND

During semiconductor fabrication process, a substrate (e.g., semiconductor wafer) may be polished or planarized one or more times to remove a portion on a top surface of the wafer. A typical polishing process is a chemical mechanical polishing (CMP), where the wafer is polished by being placed on polishing head and pressed facedown onto the polishing pad. During the polishing process, the characteristic of the polishing pad may be changed (e.g., polishing pad may be worn out), thereby reducing the polishing rate and the quality of the polished wafer. Thus, pad conditioning is performed by a conditioner to recondition the surface of the polishing pad.

However, the existing approaches do not provide an effective way to monitor conditions or profile of the polishing pad and make appropriate adjustments for the CMP apparatus.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
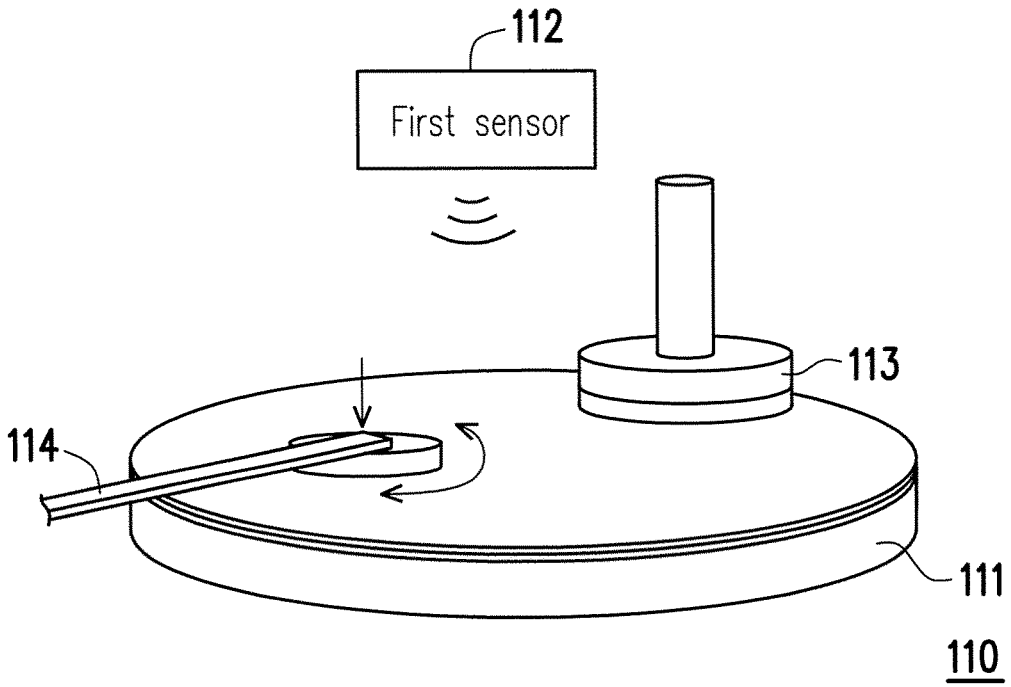
FIG. 1 illustrates a schematic view of a chemical-mechanical polishing (CMP) apparatus according to an embodiment of the present disclosure.

The following disclosure provides many different embodiments, or examples, for implementing different features of the present disclosure. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

In addition, spatially relative terms, such as "beneath," "below," "lower," "above," "upper" and the like, may be used herein for ease of description to describe one element or feature's relationship to another elements) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Referring to FIG. 1, a schematic diagram of a CMP apparatus 110 is illustrated. The CMP apparatus 110 includes a polishing pad 111, a first sensor 112, a polishing head 113 and a conditioner 114. The polishing pad 111 may have a plurality of grooves arranged randomly or in a specific grooved pattern.

The first sensor 112 is located above the polishing pad 111 and is configured to measure the pad profile of the polishing pad 111. In an embodiment, the pad profile may include the depth of each of the grooves on the polishing pad 111. In another embodiment, the pad profile may include the depth and the width of each of the grooves on the polishing pad 111. While remaining within the scope of the present disclosure, any other parameters that define the shape or appearance of the grooves on the polishing pad 111 may be included in the pad profile.

In an embodiment, the first sensor 112 may include one or more sensors which are same type or different types. The first sensor 112 may include at least one of an optical sensor, an acoustic wave sensor, an image sensor, or any other types of sensor. For an example, the first sensor 112 may include a three-dimensional laser camera which is configured to measure the three-dimensional topography (e.g., shape) of the polishing pad 111. The first sensor 112 may first generate a laser beam to the polishing pad 111 in a laser path, and receives a reflected laser beam which is reflected from the polishing pad 111. Based on the reception of the reflected laser beam, first sensor 112 may obtain the pad profile of the polishing pad 111. In another example, the first sensor 112 may include a three-dimensional image camera or a three-dimensional acoustic wave camera or any combination thereof.

The first sensor 112 may be a contact sensor or non-contact sensor as long as the pad profile could be measured. The type of the first sensor 112 and the number of the first sensor 112 are not limited in the present disclosure.

In an embodiment of the present disclosure, the first sensor 112 may be located above the polishing pad 111 so as to measure the pad profile of the polishing pad 111. For example, the first sensor 112 may be attached or embedded to the polishing head 113 or the conditioner 114 of the CMP apparatus 110. However, the present disclosure is not limited thereto, the first sensor 112 may be placed anywhere above the polishing pad 111 in contact or non-contact with the polishing pad 111.

The polishing head 113 is located above the polishing pad 111 and is configured to perform the polishing process on a substrate (e.g., semiconductor wafer). The polishing head 113 may hold the semiconductor wafer (also referred to a wafer) to face down the polishing pad 111. During polishing process, the wafer is pressed against the polishing pad III by applying a downward force to generate a pressure on the polishing head 113. The polishing pad 111 may be divided into a plurality of zones (e.g., concentric zones), and the zone pressure on the polishing head 113 may be different when the polishing head 113 is in different zones of the polishing pad 111. The polishing head 113 may rotate and moves across the surface of the polishing pad 111 with a specific or adjustable downward force to polish the wafer. The polishing head 113 is operated according to at least one polishing condition (e.g., polishing parameters), where the polishing condition may include the zone pressure of the polishing head 113 and/or the rotational speed of the polishing head 113. The at least one polishing condition is tuned according to the pad profile of the polishing pad 111 measured by the first sensor 112. It is worth noting that that the polishing head 113 is operated according a number of different parameters, and these parameters, alone or in combination, may be tuned according to the pad profile of the polishing pad 111.

The conditioner 114 is configured to recondition the polishing pad 111 so as to recover the characteristics of the polishing pad 111. The conditioner 114 may be made from metal which is embedded with diamond particles, but the present disclosure is not limited thereto. The conditioner 114 is operated according to a number of different parameters or polishing condition such as a sweep range and a sweep frequency of the conditioner, a rotational speed of the conditioner, a downward force that pushes the conditioner against the polishing pad, etc. The conditioner 114 generally rotates and moves in sweeping motion across surface of the polishing pad. 111 as indicated by the hi-directional arrow in FIG. 1.

Once the pad profile of the polishing pad 111 is measured by the first sensor 112, the at least on polishing condition (parameters) of the conditioner 114 may be tuned according to the measured pad profile. In an embodiment, at least one of the sweep range of the conditioner 114, the sweep frequency of the conditioner 114, the rotational speed of the conditioner 114, and the downward force that pushes the conditioner 114 against the polishing pad 111 are tuned according to the pad profile of the polishing pad 111. However, the present disclosure is not limited thereto and any other parameters of the conditioner 114 may be tuned according to the pad profile of the polishing pad 114.

The CMP apparatus 110 may further include a fluid delivery arm (not shown) that is configured to provide polishing slurry onto the polishing pad 111 during polishing process. The fluid delivery arm may be further configured to control a flow rate of the polishing slurry. In an embodiment of the present disclosure, the flow rate of the polishing slurry may be tuned during the polishing process according to the pad profile of the polishing pad 111.

Figure 2:
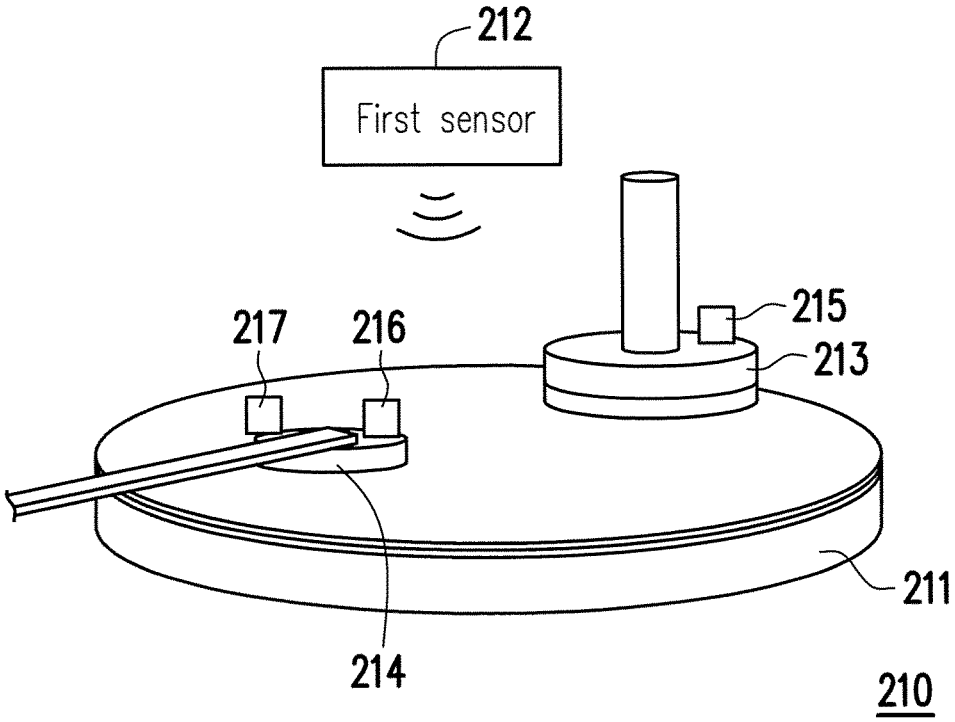
FIG. 2 illustrates a schematic view of a CMP apparatus according to another embodiment of the present disclosure.

FIG. 2 illustrates a CMP apparatus 210 according to an embodiment of the present disclosure. The CMP apparatus 200 may include a polishing pad 211 holding a wafer, a first sensor 212, a polishing head 213, a conditioner 214, a second sensor 216, a third sensor 217 and a fourth sensor 215. The polishing pad 211, the first sensor 212, the polishing head 213 and the conditioner 214 are similar to the polishing pad 111, the first sensor 112, the polishing head 113 and the conditioner 114 shown in FIG. 1, thus the detailed description of these elements are omitted herein.

The second sensor 216 is configured to measure the downward force of the conditioner 214 and the third sensor 217 is configured to measure the cutting rate of the conditioner 214. The second sensor 216 and the third sensor 217 may be located above, below or is integrated into the conditioner 214. The second sensor 216 and the third sensor 217 may be located in positions that are in the vicinity of the conditioner 214.

The fourth sensor 215 is configured to measure a thickness of the wafer. The fourth sensor 215 may be located on the polishing head 213, or integrated into the polishing head 213, or located in any position which is in the vicinity of the CMP apparatus 210. The sensors 215, 216 and 217 may operate in a contact manner or in a non-contact manner, and the type, the number and positions of the sensors are not limited in this present disclosure.

In an embodiment of the present disclosure, the polishing head 213 and the conditioner 214 are operated according to at least one polishing condition or polishing parameters. The polishing parameters may be tuned according to the pad profile measured by the first sensor 212 and/or the downward three of the conditioner 214 measured by the second sensor 216 and/or the cutting rate of the conditioner 214 measured by the third sensor 217 and/or the thickness of the wafer measured by the fourth sensor 215.

Figure 3:
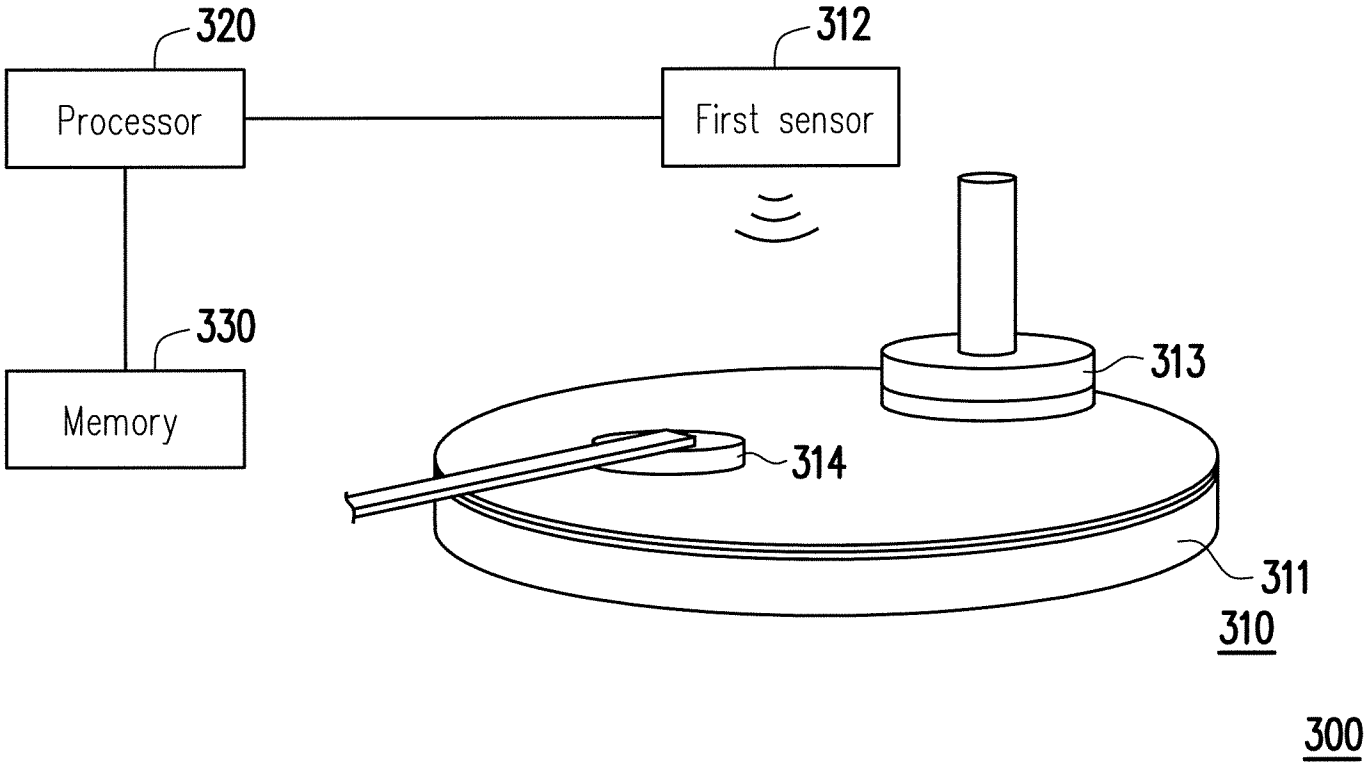
FIG. 3 illustrates a system including a CMP apparatus according to an embodiment of the present disclosure.

FIG. 3 illustrates a schematic diagram a system 300 which includes a CMP apparatus 310, a processor 320 and a memory 330. The CMP apparatus 310 may include a polishing pad 311, a first sensor 312, a polishing head 313 and a conditioner 314. The polishing pad 311, the first sensor 312, the polishing head 313 and the conditioner 314 are similar to the polishing pad 111, the first sensor 112, the polishing head 113 and the conditioner 114 in FIG. 1, thus the detailed description about these elements are omitted herein.

The first sensor 312 may be coupled to the processor 320 to transmit the measured pad profile of the polishing pad 311 to the processor 320. In turn, the processor 320 may receive the pad profile from the first sensor, and uses the received pad profile to tune the at least one polishing condition of the CMP apparatus 310. For example, the processor 320 may tune the at least one polishing condition that controls the operations of the polishing head 313 and the conditioner 314.

In an embodiment of the present disclosure, the processor 320 may receive data transmitted from the first sensor 312, and generate the pad profile of the polishing pad 311 according to the received data from the first sensor 312.

In an embodiment, the system 300 may further include one or more sensors which are configured to measure different parameters related to the operation of the CMP apparatus 310. For example, system 300 may include sensors for measuring the thickness of the wafer, the downward force of the conditioner 314, the cutting rate of the conditioner 314, the rotational speed of the conditioner 314, the rotational speed of the polishing head 313, a downward force or zone pressure of the polishing head 313, etc. These sensors may be coupled to the processor 320 to transmits the measured data to the processor 320. The processor 320 may use the measured data by the sensors and the pad profile measured by the first sensor 312 to tune the polishing condition of the CMP apparatus 310.

Figure 4A:
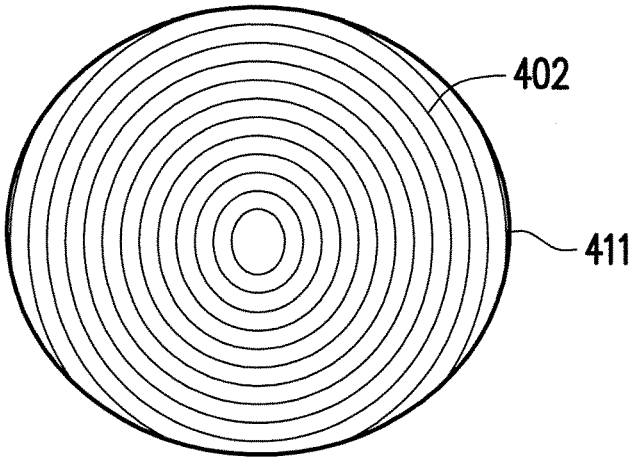
FIGS. 4A-4C illustrate a top view of different grooved patterns of a polishing pad according to an embodiment of the present disclosure.
Figure 4B:
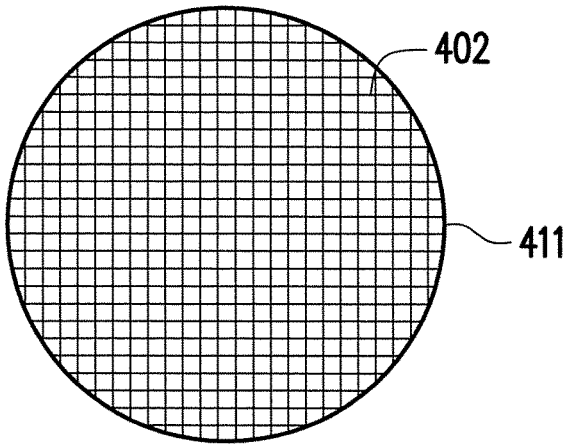
Figure 4C:
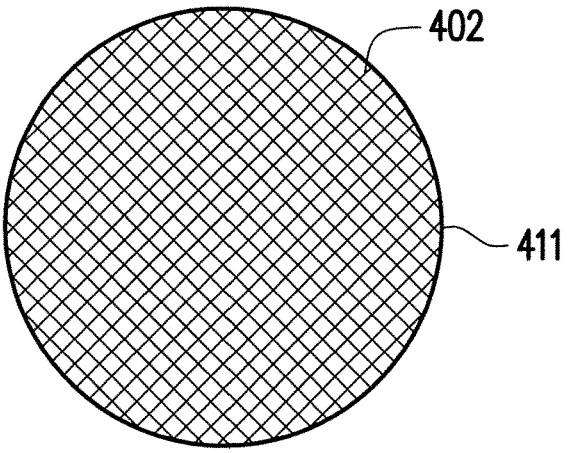

Referring now to FIGS. 4A-4C, a top view of different grooved patterns of a polishing pad 411 in a CMP apparatus is illustrated. The polishing pad 411 includes a plurality of grooves 402 formed randomly or in any specific pattern as long as the grooves are able to provide the desired functions. FIG. 4A illustrates an example of the concentric circular grooved pattern, where the plurality of the grooves 402 of the polishing pad 411 is arranged in a concentric circular shape. FIG. 4B illustrates an example of Cartesian grid grooved pattern, and FIG. 4C illustrates an example of rotated Cartesian grid grooved pattern. It should be noted that the grooved patterns shown in FIGS. 4A-4C are for illustration purpose, and the grooved patterns of the present disclosure is not limited thereto. The grooved patterns may include concentric circular pattern, radial pattern, Cartesian grid pattern, spiral pattern, rotated Cartesian grid pattern, and any combination thereof.

Figure 5:
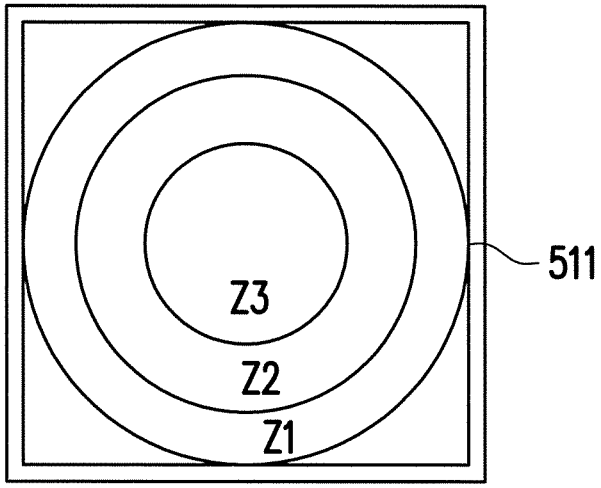
FIG. 5 illustrates different zones of a polishing pad according to an embodiment of the present disclosure.

The polishing pad in a CMP apparatus may be divided to different zones, and FIG. 5 illustrates an example of different zones Z1, Z2 and Z3 of a polishing pad 511 according to an embodiment of the present disclosure. The pad profile of the polishing pad 511 may be generated according to the grooves in different zones of the polishing pad 511. For example, the first sensor for measuring the pad profile of the polishing pad may be a three-dimensional laser camera which measures the depth and width of each of grooves according a laser path on the polishing pad. The laser pad may cross the zones of the polishing pad so that the three-dimensional laser camera may measure the depth and width of each of the grooves in each of the zones. The depths and widths of the grooves in a single zone or in multiple zones may be used to generate the pad profile of the polishing pad.

In an embodiment, the pressure of the polishing head pushing against one zone (e.g., zone pressure) of the polishing pad is different from the pressure of the polishing head pushing against another zone of the polishing pad. For example, the zone pressure of the polishing head on the zone Z1 may be different from the zone pressure of the polishing head on the zone Z2. In an embodiment of the present disclosure, the zone pressure of the polishing head is considered as one of the polishing parameters and is tuned according to the pad profile of the polishing pad.

Figure 6A:
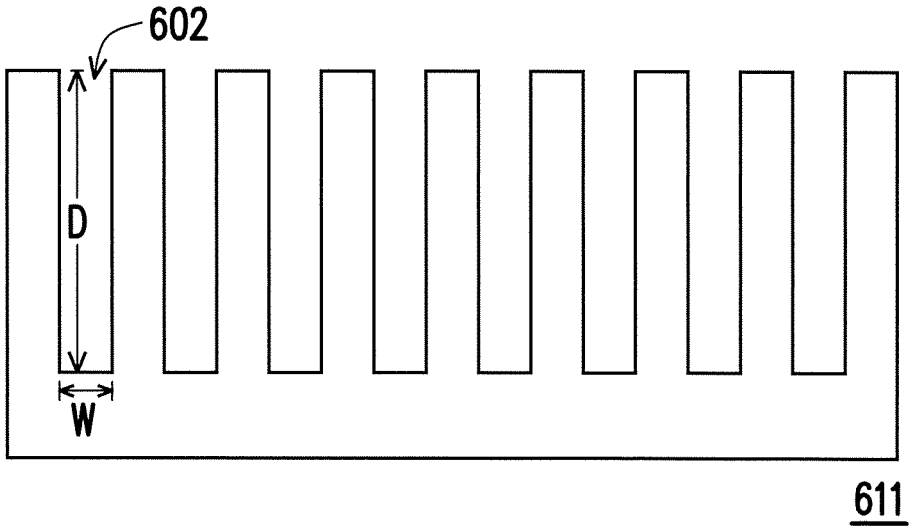
FIGS. 6A-6B illustrate a cross-sectional view of polishing pads according to an embodiment of the present disclosure.

FIG. 6A illustrates a cross-sectional view of a polishing pad 611 which includes a plurality of grooves 602. As shown in FIG. 6A, the plurality of grooves may be formed in a particular pattern, but the present disclosure is not limited thereto. Each of the grooves 602 shown in FIG. 6A has a depth D and a width W, and the depth D and the width W of each of the grooves 602 may be measured by the first sensor to generate the pad profile.

Figure 6B:
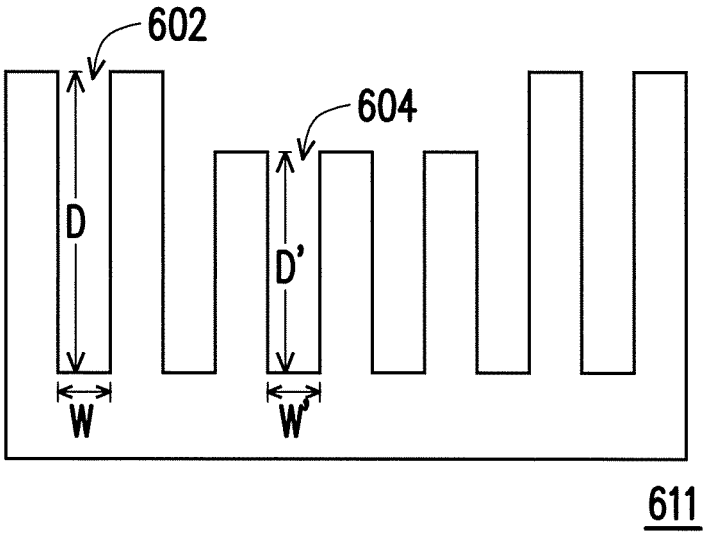

FIG. 6B illustrates a cross-sectional view of a polishing pad 611 which includes a plurality of grooves 602 and grooves 604. The grooves 602 have the depth D and the width W, and the grooves 604 have the depth D' and the width W'. The depth D' is smaller than the depth D and the width W' may be the same or different from the width W.

As a result of the polishing process, the grooves 602 may be changed to the grooves 604. Since the surface of the polishing pad 611 shown in FIG. 6B is non-uniform, it may disadvantageously cause a variety of issues for the polishing process such as reducing lifetime of the polishing pad, affecting to the quality of the polishing process, etc.

Figure 7:
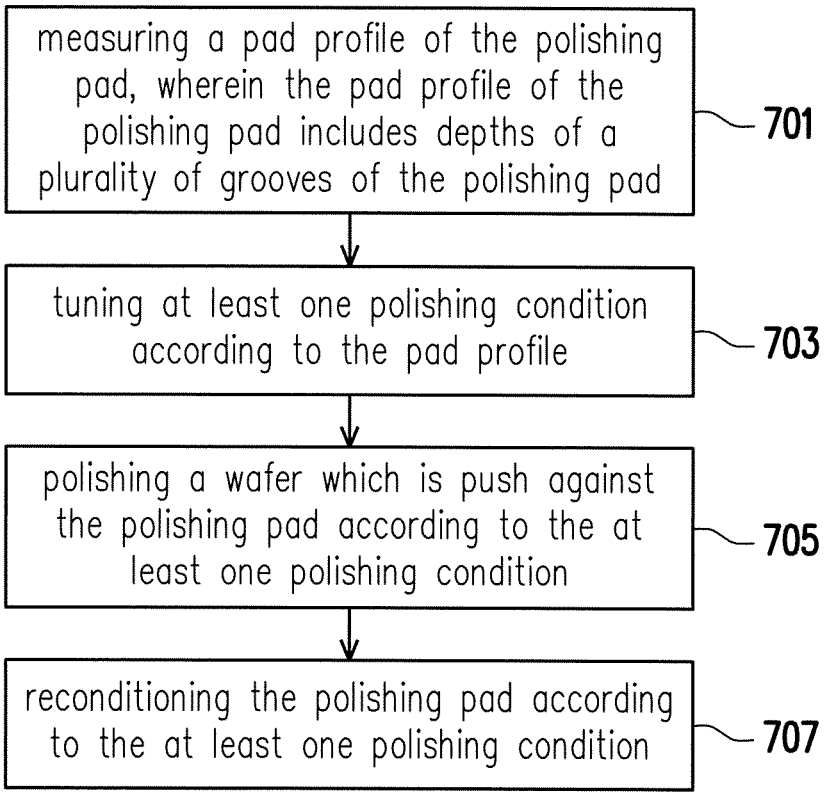
FIG. 7 illustrates a flowchart of a control method of a CMP apparatus according to an embodiment of the present disclosure.

Referring to FIG. 7, a flowchart of a control method of a CMP apparatus is illustrated. In step 701, a pad profile of the polishing pad is measured by the first sensor, wherein the pad profile of the polishing pad includes depths of a plurality of grooves of the polishing pad.

In step 702, at least one polishing condition is tuned according to the pad profile. In an embodiment, the at least one polishing condition may include at least one of a sweep range and a sweep frequency of the conditioner, a rotational speed of the conditioner, a downward force that pushes the conditioner against the polishing pad, and a zone pressure of the polishing head. Yet in an embodiment, additional sensors may be applied to measures the cutting rate of the conditioner, the downward force of the conditioner and the thickness of the wafer. The at least one polishing condition is tuned according to the pad profile and/or the measured cutting rate and/or the measured downward force and/or the thickness of the wafer.

In step 705, the polishing head is controlled according to the at least one polishing condition to polish the wafer which is pushed against the polishing pad. In step 707, the conditioner is controlled according to the at least one polishing condition to recondition the polishing pad.

According to some embodiments of the present disclosure, a chemical mechanical polishing (CMP) apparatus are introduced. The CMP apparatus may include a polishing pad having a plurality of groves arranged randomly or in a specific pattern. The CMP apparatus further comprises a first sensor which is configured to measure the pad profile of the polishing pad, where the pad profile includes the depth of each of the grooves on the polishing pad. The CMP apparatus further comprises a polishing head and a conditioner which are operated according to at least on polishing condition, where the polishing condition is tuned according to the pad profile of the polishing pad measured by the first sensor. By measuring the pad profile of the polishing pad by the first sensor, the CMP apparatus may tune the polishing condition of the conditioner according to the pad profile to recondition the polishing pad more effectively. In addition, the CMP apparatus may also tune the polishing condition of the polishing head according to the pad profile so as to improve the performance of the polishing process. As a result, the time life of the polishing pad is increased, the defects and issues during the polishing process are reduced, and the performance of the polishing process is improved.

In an embodiment, a chemical mechanical polishing (CMP) apparatus is provided. The CPM apparatus includes a polishing pad, a first sensor, a polishing head and a conditioner. The polishing pad comprises a plurality of grooves on the polishing pad. The first sensor is configured to measure a pad profile of the polishing pad, wherein the pad profile of the polishing pad includes depths of the plurality of grooves. The polishing head is located above the polishing pad and is configured to polish a wafer which is push against the polishing pad according to the pad profile. The conditioner is located above the polishing pad and is configured to recondition the polishing pad according to the pad profile. The polishing head and the conditioner are operated according to at least one polishing condition, and the polishing condition is tuned according to the pad profile of the polishing pad.

In some embodiments, the first sensor is configured to measure a depth of each of the plurality of grooves and a width of each of the plurality of grooves to obtain the pad profile of the polishing pad.

In some embodiments, the first sensor includes at least one of an optical sensor, an acoustic wave sensor and an image sensor.

In some embodiments, the first sensor includes a three-dimensional laser sensor.

In some embodiments, the at least one polishing condition includes at least one of a sweep range of the conditioner, a sweep frequency of the conditioner, a rotational speed of the conditioner, a downward force that pushes the conditioner against the polishing pad, and a zone pressure of the polishing head.

In some embodiments, the CMP apparatus further comprises a second sensor and a third sensor. The second sensor is configured to measure a downward force that pushes the conditioner against the polishing pad. The third sensor is configured to measure a cutting rate of the conditioner. The at least one polishing condition is tuned according to the pad profile and at least one of the downward force and the cutting rate of the conditioner.

In some embodiments, the CMP apparatus further comprises a fourth sensor. The fourth sensor is configured to measure a thickness of the wafer. The at least one polishing condition is tuned according to the pad profile and at least one of the downward force, the cutting rate of the conditioner and the thickness of the wafer.

In some embodiments, the CMP apparatus further comprises a fifth sensor. The fifth sensor is configured to measure a thickness of the wafer. The at least one polishing condition is tuned according to the pad profile and the thickness of the wafer.

In an embodiment, a control method of chemical mechanical polishing (CMP) apparatus having a polishing pad, a first sensor, a polishing head and a conditioner is provided. the control method comprises: measuring, by the first sensor, a pad profile of the polishing pad, wherein the pad profile of the polishing pad includes depths of a plurality of grooves of the polishing pad; tuning at least one polishing condition according to the pad profile; polishing, by the polishing head, a wafer which is push against the polishing pad according to the at least one polishing condition; and, reconditioning, by the conditioner, the polishing pad according to the at least one polishing condition.

In some embodiments, the step of measuring the pad profile of the polishing pad comprises: measuring a depth of each of the plurality of grooves of the polishing pad; and, measuring a width of each of the plurality of grooves of the polishing pad.

In some embodiments, the first sensor includes at least one of an optical sensor, an acoustic wave sensor and an image sensor.

In some embodiments, the first sensor includes a three-dimensional laser sensor.

In some embodiments, the at least one polishing condition includes at least one of a sweep range and a sweep frequency of the conditioner, a rotational speed of the conditioner, a downward force that pushes the conditioner against the polishing pad, and a zone pressure of the polishing head.

In some embodiments, the control method further comprises: measuring a downward force that pushes the conditioner against the polishing pad; and, measuring a cutting rate of the conditioner. the step of tuning at least one polishing condition according to the pad profile comprises: tuning the at least one polishing condition according to the pad profile and at least one of the downward force and the cutting rate of the conditioner.

In some embodiments, the control method further comprises: measuring a thickness of the wafer. The step of tuning at least one polishing condition according to the pad profile further comprises: tuning the at least one polishing condition according to the pad profile and at least one of the downward force, the cutting rate of the conditioner and the thickness of the wafer.

In an embodiments, a system is provided. The system comprises a chemical mechanical polishing (CMP) apparatus, a memory, and a controller. The CMP apparatus comprises a polishing pad, a first sensor, a polishing head, and a conditioner. The polishing pad comprises a plurality of grooves on the polishing pad. The first sensor is configured to measure a pad profile of the polishing pad, wherein the pad profile of the polishing pad includes depths of the plurality of grooves. The polishing head is located above the polishing pad and is configured to polish a wafer which is push against the polishing pad according to the pad profile. The conditioner is located above the polishing pad and is configured to recondition the polishing pad according to the pad profile. The memory is configured to store program instructions. The controller is coupled to the memory and the CMP apparatus, and is configured to execute the program instructions stored in the memory to: tune at least one polishing condition according to the pad profile of the polishing pad; and control the polishing head and the conditioner according to the at least one polishing condition.

In some embodiments, the first sensor is configured to measure a depth of each of the plurality of grooves and a width of each of the plurality of grooves.

In some embodiments, the at least one polishing condition includes at least one of a sweep range and a sweep frequency of the conditioner, a rotational speed of the conditioner, a downward force that pushes the conditioner against the polishing pad, and a zone pressure of the polishing head.

In some embodiments, the system further comprises a second sensor, a third sensor, and a forth sensor. The second sensor is configured to measure a downward force that pushes the conditioner against the polishing pad. The third sensor is configured to measure a cutting rate of the conditioner. The forth sensor is configured to measure a thickness of the wafer. The at least one polishing condition is tuned according to the pad profile and at least one of the downward force, the cutting rate of the conditioner, and the thickness of the wafer.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A chemical mechanical polishing (CMP) apparatus, comprising:

a polishing pad that comprises a plurality of grooves on the polishing pad;

a first sensor, configured to measure a pad profile of the polishing pad, wherein the measured pad profile of the polishing pad includes measuring depths and widths of the plurality of grooves;

a polishing head, located above the polishing pad and configured to polish a wafer which is push against the polishing pad according to the measured pad profile; and a conditioner, located above the polishing pad and configured to recondition the polishing pad according to the measured pad profile, wherein the polishing head and the conditioner are operated according to at least one condition, the at least one condition includes a rotational speed of the conditioner or a downward force pushing the conditioner against the polishing pad, wherein the condition is tuned, during the measuring, according to the measured depths and widths of the plurality of grooves included in the measured pad profile of the polishing pad.

2. The CMP apparatus of claim 1, wherein the first sensor includes at least one of an optical sensor, an acoustic wave sensor and an image sensor.

3. The CMP apparatus of claim 1, wherein the first sensor includes a three-dimensional laser sensor.

4. The CMP apparatus of claim 1, wherein the at least one condition further includes at least one of a sweep range of the conditioner, a sweep frequency of the conditioner, and a zone pressure of the polishing head.

5. The CMP apparatus of claim 1, further comprising: a second sensor, configured to measure the downward force that pushes the conditioner against the polishing pad; and a third sensor, configured to measure a cutting rate of the conditioner, wherein the at least one condition is tuned according to the pad profile and at least one of the downward force and the cutting rate of the conditioner.

6. The CMP apparatus of claim 5, further comprising: a fourth sensor, configured to measure a thickness of the wafer, wherein the at least one condition is tuned according to the pad profile and at least one of the downward force, the cutting rate of the conditioner and the thickness of the wafer.

7. The CMP apparatus of claim 6, further comprising: a fifth sensor, configured to measure a thickness of the wafer, wherein the at least one condition is tuned according to the pad profile and the thickness of the wafer.

8. A control method of chemical mechanical polishing (CMP) apparatus having a polishing pad, a first sensor, a polishing head and a conditioner, the control method comprising:

measuring, by the first sensor, a pad profile of the polishing pad, wherein the measuring of the pad profile of the polishing pad includes measuring depths and widths of a plurality of grooves of the polishing pad;

tuning, during the measuring, at least one condition that includes a rotational speed of the conditioner or a downward force pushing the conditioner against the polishing pad according to the measured depths and widths of the plurality of grooves included in the measured pad profile;

polishing, by the polishing head, a wafer which is push against the measured pad profile of the polishing pad according to the at least one condition; and reconditioning, by the conditioner, the measured pad profile of the polishing pad according to the at least one condition.

9. The control method of claim 8, wherein the first sensor includes at least one of an optical sensor, an acoustic wave sensor and an image sensor.

10. The control method of claim 8, wherein the first sensor includes a three-dimensional laser sensor.

11. The control method of claim 8, wherein the at least one condition further includes at least one of a sweep range and a sweep frequency of the conditioner, and a zone pressure of the polishing head.

12. The control method of claim 8, further comprising: measuring the downward force that pushes the conditioner against the polishing pad; and measuring a cutting rate of the conditioner, wherein the step of tuning at least one condition according to the pad profile comprises: tuning the at least one condition according to the pad profile and at least one of the downward force and the cutting rate of the conditioner.

13. The control method of claim 12, further comprising: measuring a thickness of the wafer, wherein the step of tuning at least one condition according to the pad profile comprises: tuning the at least one condition according to the pad profile and at least one of the downward force, the cutting rate of the conditioner and the thickness of the wafer.

14. The control method of claim 8, further comprising: measuring a thickness of the wafer, wherein the step of tuning at least one condition according to the pad profile comprises: tuning the at least one condition according to the pad profile and the thickness of the wafer.

15. A system, comprising:

a chemical mechanical polishing (CMP) apparatus, comprising:

a polishing pad that comprises a plurality of grooves on the polishing pad, a first sensor, configured to measure a pad profile of the polishing pad, wherein the measuring of the pad profile of the polishing pad includes measuring depths and widths of the plurality of grooves;

a polishing head, located above the polishing pad and configured to polish a wafer which is push against the polishing pad according to the measured pad profile; and a conditioner, located above the polishing pad and configured to recondition the polishing pad according to the measured pad profile;

a memory, configured to store program instructions; and a controller, coupled to the memory and the CMP apparatus, and is configured to execute the program instructions stored in the memory to:

tune, during the measuring at least one condition that includes a rotational speed of the conditioner or a downward force pushing the conditioner against the polishing pad according to the measured depths and widths of the plurality of grooves included in the measured pad profile of the polishing pad; and control the polishing head and the conditioner according to the at least one condition.

16. The system of claim 15, wherein the at least one condition includes at least one of a sweep range and a sweep frequency of the conditioner, and a zone pressure of the polishing head.

17. The system of claim 15, further comprising: a second sensor, configured to measure the downward force that pushes the conditioner against the polishing pad; a third sensor, configured to measure a cutting rate of the conditioner; and a forth sensor, configured to measure a thickness of the wafer, wherein the at least one condition is tuned according to the pad profile and at least one of the downward force, the cutting rate of the conditioner, and the thickness of the wafer.

* * * * *